US008251751B2

(12) United States Patent
Huang et al.

(10) Patent No.: US 8,251,751 B2
(45) Date of Patent: Aug. 28, 2012

(54) PLUG AND CONNECTOR ASSEMBLY USING SAME

(75) Inventors: Mao-Sheng Huang, Taipei Hsien (TW); Chuang Yue, Shenzhen (CN); Lie Zhang, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 197 days.

(21) Appl. No.: 12/841,187

(22) Filed: Jul. 22, 2010

(65) Prior Publication Data

US 2011/0300763 A1 Dec. 8, 2011

(30) Foreign Application Priority Data

Jun. 3, 2010 (CN) ..... 2010 1 0191252

(51) Int. Cl.
*H01R 33/00* (2006.01)

(52) U.S. Cl. ..... 439/660; 439/668

(58) Field of Classification Search ..... 439/660, 439/607.01, 607.17, 607.19, 607.2, 607.27, 439/607.31, 607.4, 607.41, 862, 668
See application file for complete search history.

(56) References Cited

U.S. PATENT DOCUMENTS

| | | | | |
|---|---|---|---|---|
| 5,655,913 | A * | 8/1997 | Castaneda et al. | 439/66 |
| 7,309,238 | B2 * | 12/2007 | Yang | 439/71 |
| 7,559,805 | B1 * | 7/2009 | Yi et al. | 439/660 |
| 7,811,110 | B2 * | 10/2010 | He et al. | 439/218 |
| 2006/0234557 | A1 * | 10/2006 | Chen | 439/609 |
| 2008/0014797 | A1 * | 1/2008 | Yang | 439/607 |
| 2009/0035992 | A1 * | 2/2009 | Wu | 439/607 |

* cited by examiner

*Primary Examiner* — Thanh Tam Le
(74) *Attorney, Agent, or Firm* — Altis Law Group, Inc.

(57) ABSTRACT

The present invention relates to a plug. The plug includes a plug body, a fixing frame, and a number of elastic plates. The plug body is made of an insulating material. A number of gold fingers are disposed on the outer surface of the plug body. The fixing frame is made of a conductive material and sleeves the plug body. The elastic plates are disposed on inner sidewalls of the fixing frame and electrically connected to the fixing frame. Each elastic plate includes an apex. The present disclosure also relates to a connector assembly using the plug.

12 Claims, 5 Drawing Sheets

PLUG AND CONNECTOR ASSEMBLY USING SAME

BACKGROUND

1. Technical Field

The present disclosure relates to a plug and a connector assembly using the plug.

2. Description of Related Art

Connectors generally include a socket and a plug. In use, the socket and the plug represent two connecting ends of two electronic devices, respectively, and the plug is plugged into the socket to provide quick connection between the two electronic devices. Generally, both the socket and the plug include a number of electrical contacts for establishing electrical connection between the socket and the plug. However, the electrical contacts generate electromagnetic waves when conducting electricity, adversely interfering with the electronic devices.

Therefore, it is desirable to provide a plug and a connector assembly using the same that can overcome the above-mentioned limitations.

BRIEF DESCRIPTION OF THE DRAWINGS

Many aspects of the embodiments should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
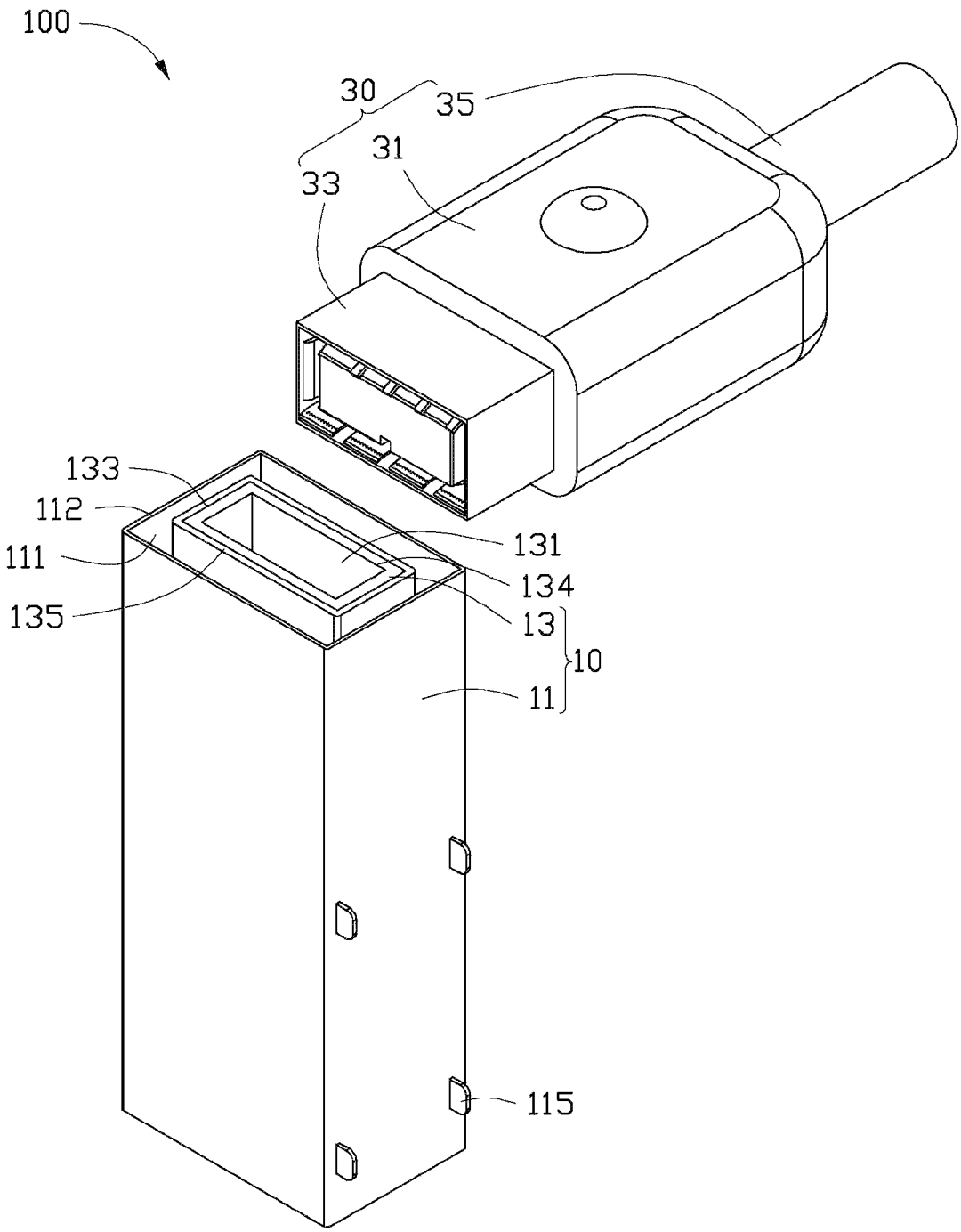
FIG. 1 is a schematic, isometric view of a connector assembly, according to an embodiment.

Referring to FIG. 1, a connector assembly 100, according to an embodiment, is configured for connecting a first electronic device (not shown) to a second electronic device (not shown). In the present embodiment, the first electronic device can be a computer motherboard. The second electronic device can be a portable hard disk, and the signal transmitted can be a FIREWIRE signal. It can be understood that the second electronic device can be other electronic devices complying with FIREWIRE interface.

The connector assembly 100 includes a socket 10 and a plug 30, respectively connecting the first electronic device and the second electronic device. The plug 30 is inserted into the socket 10.

The socket 10 includes a cuboid or substantially cubic housing 11 and a cuboid or substantially cubic socket body 13. The housing 11 defines a cuboid first insertion groove 111 in one end surface (not labeled, e.g., a front surface) thereof along the inserting direction of the plug 30. The groove 111 extends from a rectangular opening 112 of the housing 11. The housing 11 is made of conductive material (e.g., metal). Four grounding pins 115 are positioned on an outer surface of the housing 11 and thus the housing 11 can be grounded by connect the grounding pins 115 to ground. The socket body 13 is received in the first insertion groove 111 along the inserting direction of the plug 30. The socket body 13 is made of insulating material (e.g., plastic) and defines a cuboid second insertion groove 131 bounded by four boards 133. The outer surfaces of the four boards 133 are covered by a layer of conductor 135 (e.g., copper foil). The first gold fingers 136 (see FIG. 5) are positioned on two inner surfaces 134 of the socket body 13, respectively, and configured for electrically connecting the socket 10 to the first electronic device (not shown).

Figure 2:
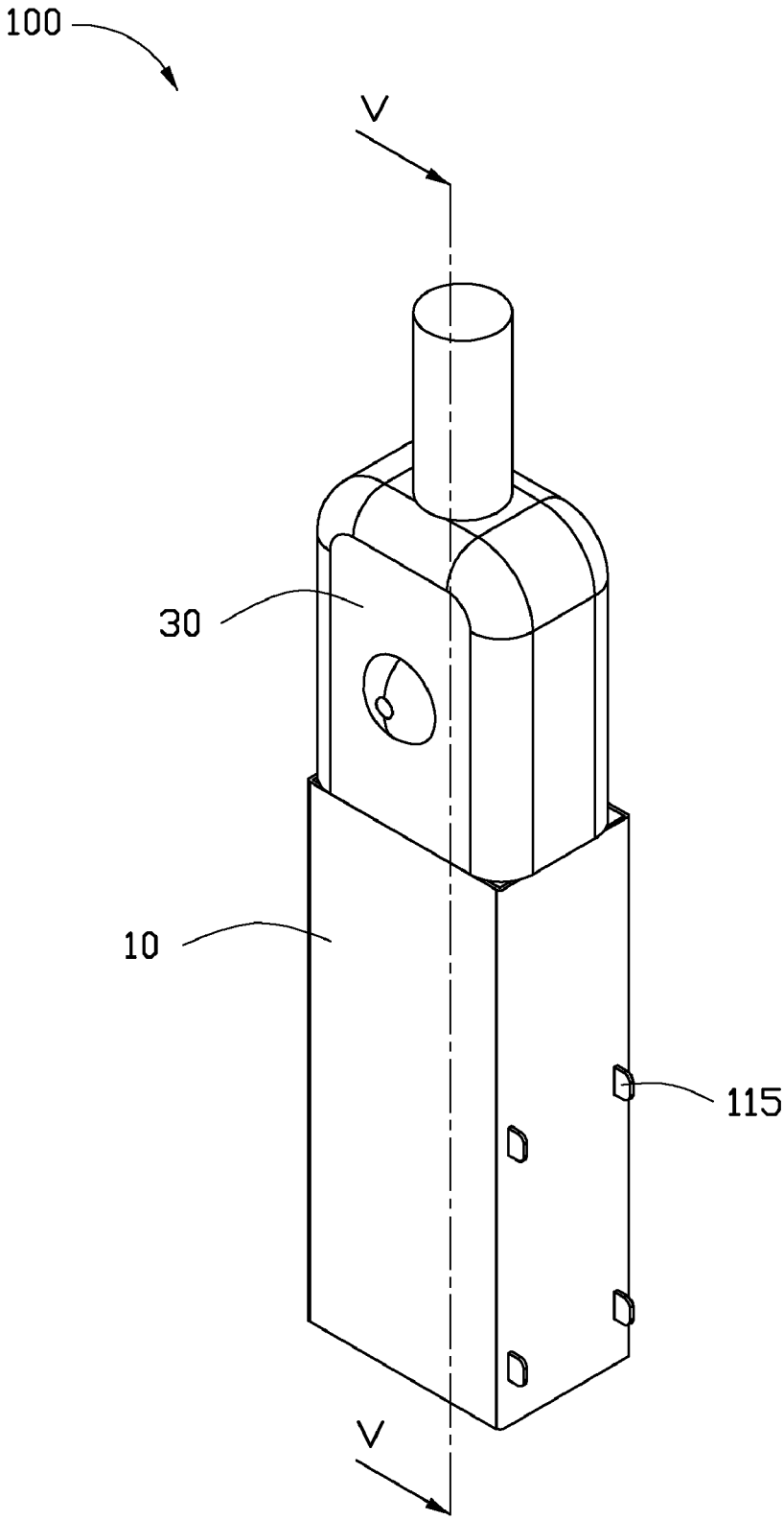
FIG. 2 is similar to FIG. 1, but showing the connector assembly in another operation state.
Figure 3:
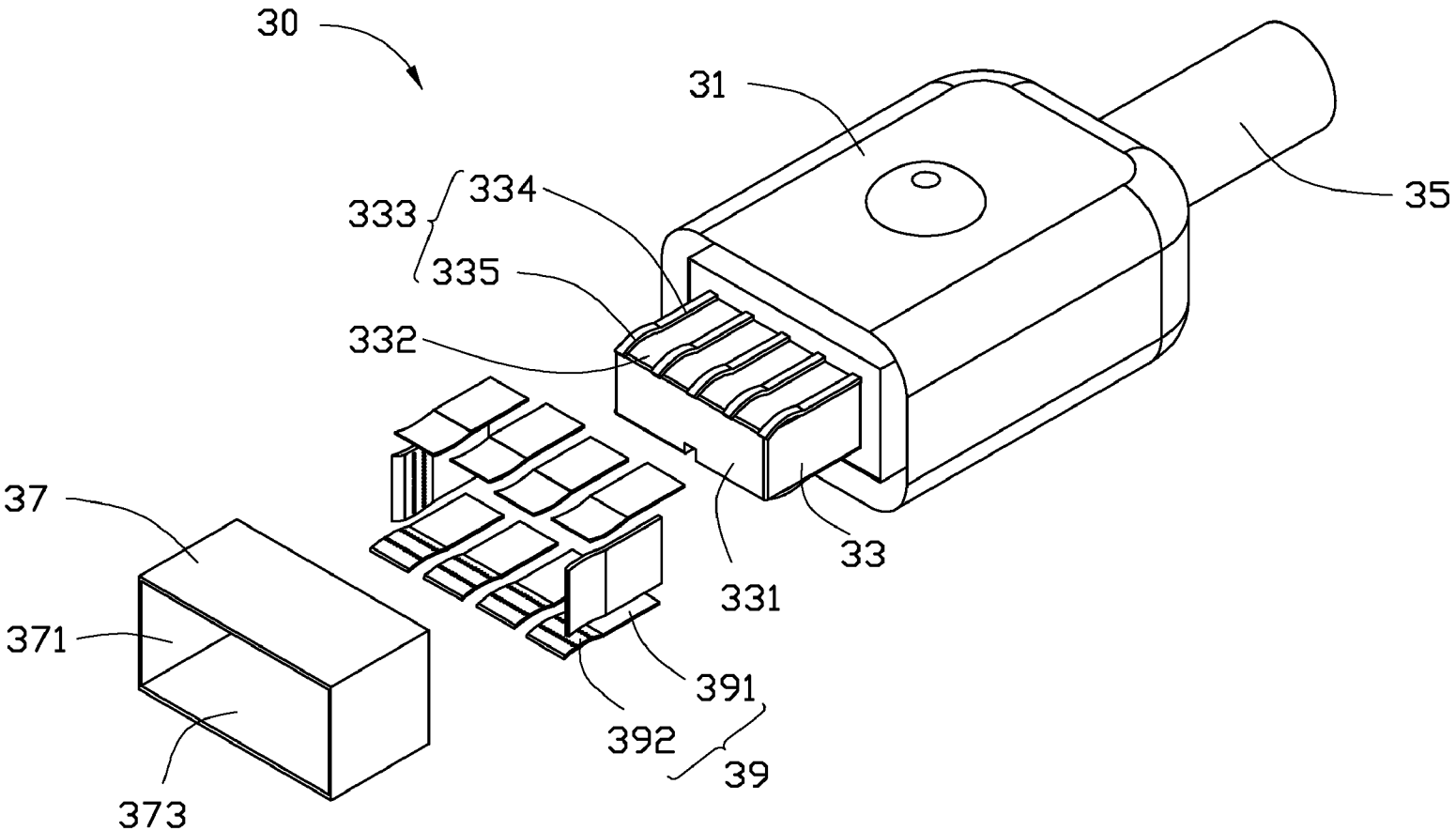
FIG. 3 is an exploded view of a plug of the connector assembly of FIG. 1.

Referring to FIG. 2 and FIG. 3, the plug 30 is complementary to the socket 10 in shape and includes counterparts of the socket 10. In particular, the plug 30 includes a cuboid connecting block 31, a cuboid plug body 33, a data line 35, a cuboid fixing frame 37, and ten elastic plates 39. The plug body 33 and the data line 35 extend from two opposite ends of the connecting block 31. The plug body 33 is made of insulated material (e.g., plastic) and can be fittingly inserted into the second insertion groove 131. In detail, the plug body 33 includes two parallel fixing boards 332 extending outward from the connecting block 31 and a head board 331 perpendicularly connecting the two fixing boards 332. The two fixing boards 332 are corresponding to the two inner surfaces 134 respectively. The second gold fingers 333 (see FIG. 5) are positioned on the two fixing boards 332 corresponding to the first gold fingers 136 respectively. The second gold fingers 333 are counterparts of the first gold fingers 136 respectively and are designed to match each other so that when the plug 30 is plugged into the socket 10, the first and second gold fingers 136, 333 are coupled with each other (see FIG. 6), that is, the first and second gold fingers 136 and 333 can transmit electrical signal therebetween. The data line 35 is electrically connected to the second gold fingers 333 for transmitting signal between the plug body 33 and the second electronic device (not shown).

In particular, each second gold finger 333 includes a fixing portion 334 and a curved portion 335 extending from the fixing portion 334. Each fixing portion 334 is slice-shaped and configured for fixing the corresponding second gold finger 333 to the fixing board 332. Each curved portion 335 has a protruding spherical or aspherical surface bulging inward and thus the first gold and the second finger 136, 333 abut against each other when the plug body 33 inserts into the second insertion groove 131 to form a proper contact therebetween.

Figure 4:
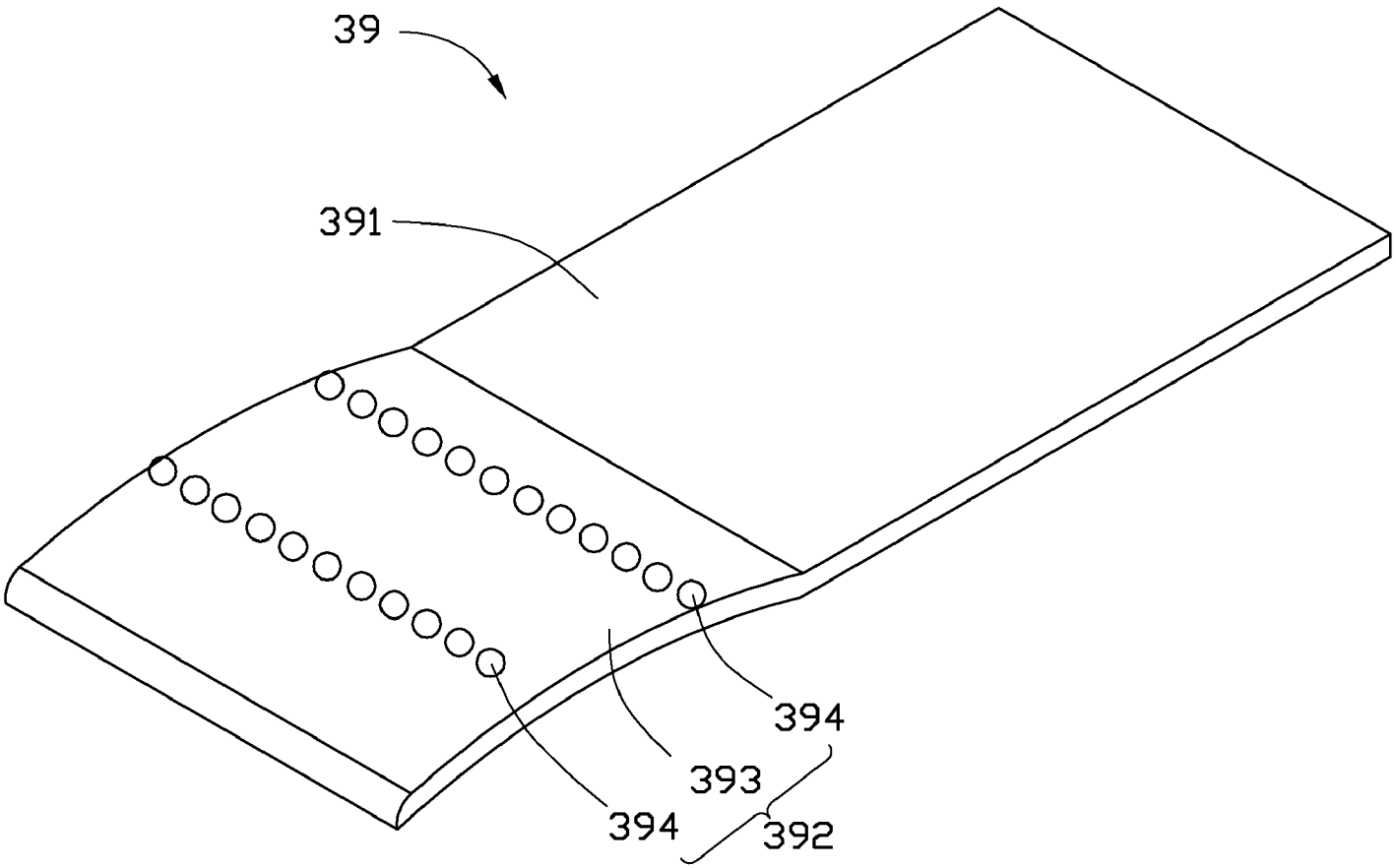
FIG. 4 is an isometric view of a metal elastic plate of the connector assembly of FIG. 1.

The fixing frame 37 is made of conductive material (i.e. metal) and encompasses the plug body 33 with a distance comprised between the fixing frame 37 and the plug body 33. The fixing frame 37 includes four inner sidewalls 373 and an inserting interface 371 bounded by the four inner sidewalls 373. The elastic plates 39 are fixed to the four inner sidewalls 373 respectively. Referring to FIG. 4, each elastic plate 39 includes a connecting portion 391 and an elastic portion 392 extending outward from one end of the connecting portion 391. Each connecting portion 391 is slice-shaped and is configured for fixing the corresponding elastic plate 39 to the inner sidewalls 373. In this present embodiment, the connecting portion 391 is soldered to the inner sidewall 373, but other fixing techniques may be used for other alternative embodiments. The elastic portion 392 has a protruding spherical or aspherical surface and includes an apex 393 and a number of protruding dots 394 equidistantly arranged on two opposite sides of the apex 393. The apex 393 protrudes toward the plug body 33. The protruding dots 394 on the same side are arranged in a line perpendicular to the extending direction of the elastic portion 392 and thus both of the apexes 393 and the protruding dots 394 abut against the conductor 135 when the elastic portion 392 expands to the contact surface therebetween and creates a friction fit.

Figure 5:
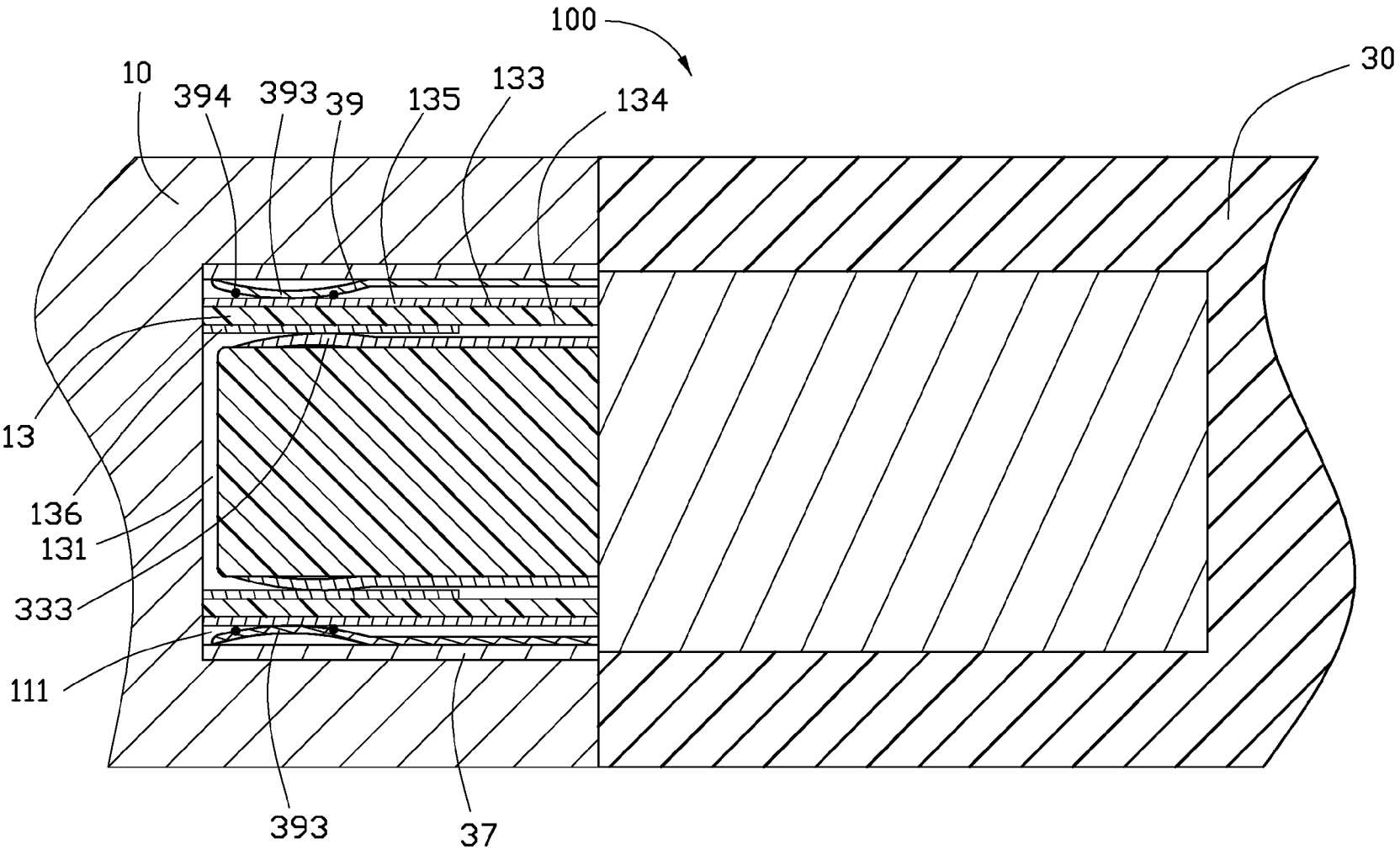
FIG. 5 is a partial, cross-sectional view taken along a line V-V of FIG. 2.

Referring to FIG. 5, in use, when the plug 30 is inserted into the socket 10, the fixing frame 37 is inserted into the first insertion groove 111 and the plug body 33 is inserted into the second insertion groove 131, so that, the second gold fingers 333 connect the corresponding first gold fingers 136 respectively. The apexes 393 provide resistance against the conductor 135 firmly to make the apexes 393 elastically resist, so that the protruding dots 394 also resist against the conductor 135. As a result, most of electromagnetic waves generated by the first and the second gold fingers 136, 333 broadcast to the conductor 135 through the shortest path and is transformed into electric charges on the conductor 135, and then the charges are released to the ground through the path from the conductor 135, to the elastic plate 39, the fixing frame 37 and the housing 11, to prevent interference between the first and second electric devices.

The numbers of the first gold and second gold fingers 136, 333, and the elastic plate 39 are not limited to the quantity described in this embodiment. In other alternative embodiments, more than or less than the first gold fingers 136, second gold fingers 333 (one set including a first gold finger 136 and a second gold finger 333), more than or less than ten elastic plates 39 may be employed based on application and need. And the first gold and second gold fingers 136, 333 are not limited to fixed on the two inner surfaces 134 and the fixing boards 332, respectively, but can also be fixed on other surfaces.

The shapes of the housing 11, the socket body 13, the plug body 33 and the fixing frame 37 are also not limited to this embodiment, but can take other geometrical shapes (such as cylinders) in other alternative embodiments. The conductor 135 is not limited to copper foil, but can employ other conducting materials (such as aluminum foils) in other alternative embodiments. The protruding dots 394 can also be randomly, instead of linearly and equidistantly, arranged.

It will be understood that the above particular embodiments and methods are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A plug comprising:

a plug body made of insulating material;

a plurality of gold fingers positioned on a plurality of outer surfaces of the plug body;

a fixing frame made of a conductive material and sleeved around the plug body; and a plurality of elastic plates positioned on inner sidewalls of the fixing frame and electrically connected with the fixing frame; each elastic plate comprising an elastic portion having an apex, wherein the elastic portion of each elastic plate comprises a plurality of protruding dots equidistantly arranged on two opposite sides of the apex.

2. The plug in claim 1, wherein the protruding dots on the same side of the apex are arranged in a line perpendicular to the extending direction of the elastic portion.

3. A connector assembly comprising:

a socket comprising:

a housing made of a conductive material and defined a first insertion groove, and the housing grounded;

a socket body made of an insulating material and received in the first insertion groove, an outer surface of the socket body being covered by a layer of conductor, the socket body defining a second insertion groove comprising a plurality of inner surfaces; and a plurality of first gold fingers positioned on the plurality of the inner surfaces; and a plug operable to connect with the socket, comprising:

a plug body made of an insulating material;

a plurality of second gold fingers positioned on a plurality of outer surfaces of the plug body;

a fixing frame made of a conductive material and sleeved around the plug body; and a plurality of elastic plates positioned on an inner surface of the fixing frame and electrically connected with the fixing frame; each elastic plate comprising an elastic portion having an apex;

wherein when the plug is inserted into the socket, the fixing frame is inserted into the first insertion groove and the plug body is inserted into the second insertion groove, the second gold fingers connect the corresponding first gold fingers respectively, the apexes provide resistance against the conductor firmly to make the apexes elastically resist.

4. The connector assembly in claim 3, wherein a plurality of grounded pins are positioned on the outer surface of the housing.

5. The connector assembly in claim 3, wherein the elastic portion of each elastic plate comprises a plurality of protruding dots equidistantly arranged on two opposite sides of the apex.

6. The connector assembly in claim 5, wherein the protruding dots on the same side of the apex are arranged in a line perpendicular to the extending direction of the elastic portion.

7. The connector assembly in claim 3, wherein each elastic plate comprises a connecting portion extending from the elastic portion and configured for fixing the elastic plate on the inner sidewalls of the fixing frame.

8. The connector assembly in claim 3, wherein each second gold finger comprises a fixing portion and a curved portion extending from one end of the fixing portion.

9. The connector assembly in claim 3, wherein the plug comprises a data line connected with the second gold fingers and configured for transmitting the signal.

10. The connector assembly in claim 3, wherein the conductor is a copper foil or an aluminum foil.

11. The connector assembly in claim 3, wherein the housing is cube-shaped or cylinder-shaped.

12. The connector assembly in claim 3, wherein the socket body is cube-shaped or cylinder-shaped.

* * * * *